US007488157B2

(12) United States Patent
Marini et al.

(10) Patent No.: US 7,488,157 B2
(45) Date of Patent: Feb. 10, 2009

(54) TURBINE VANE WITH REMOVABLE PLATFORM INSERTS

(75) Inventors: Bonnie D. Marini, Oviedo, FL (US); Anthony L. Schiavo, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 100 days.

(21) Appl. No.: 11/494,177

(22) Filed: Jul. 27, 2006

(65) Prior Publication Data

US 2008/0025842 A1 Jan. 31, 2008

(51) Int. Cl.
*F01D 5/14* (2006.01)

(52) U.S. Cl. ..... 416/193 A; 416/224

(58) Field of Classification Search ..... 416/193 A, 416/224, 62, 96 A, 196, 197, 214 A; 29/889.1; 415/214 A See application file for complete search history.

(56) References Cited

U.S. PATENT DOCUMENTS

| | | | | |
|---|---|---|---|---|
| 2,013,512 | A | 9/1935 | Birmann | |
| 2,299,449 | A | 10/1942 | Allen | |
| 2,914,300 | A | 11/1959 | Sayre | |
| 3,583,824 | A | 6/1971 | Smuland et al. | |
| 3,873,234 | A | 3/1975 | Penny | |
| 3,986,793 | A | 10/1976 | Warner et al. | |
| 4,025,229 | A | 5/1977 | Browning et al. | |
| 4,026,659 | A | 5/1977 | Freeman, Jr. | |
| 4,305,697 | A * | 12/1981 | Cohen et al. | 415/210.1 |
| 4,650,399 | A | 3/1987 | Craig et al. | |
| 4,872,812 | A | 10/1989 | Hendley et al. | |
| 5,067,876 | A | 11/1991 | Moreman, III | |
| 5,083,903 | A | 1/1992 | Erdmann | |
| 5,222,865 | A | 6/1993 | Corsmeier | |
| 5,244,345 | A | 9/1993 | Curtis | |
| 5,259,728 | A | 11/1993 | Szpunar et al. | |
| 5,350,279 | A | 9/1994 | Prentice et al. | |
| 5,421,703 | A | 6/1995 | Payling | |
| 5,421,704 | A | 6/1995 | Carletti et al. | |
| 5,443,365 | A | 8/1995 | Ingling et al. | |
| 5,735,673 | A | 4/1998 | Matheny et al. | |
| 5,820,347 | A | 10/1998 | Bussonnet et al. | |
| 5,997,245 | A | 12/1999 | Tomita et al. | |
| 6,013,592 | A | 1/2000 | Merrill et al. | |
| 6,196,794 | B1 | 3/2001 | Matsumoto | |
| 6,283,713 | B1 | 9/2001 | Harvey et al. | |
| 6,287,511 | B1 | 9/2001 | Merrill et al. | |

(Continued)

FOREIGN PATENT DOCUMENTS

| | | | |
|---|---|---|---|
| JP | 2002234777 | A | 8/2002 |

(Continued)

*Primary Examiner*—Richard Edgar

(57) ABSTRACT

Aspects of the invention are related to a turbine vane assembly in which at least one of the platforms is equipped with one or more removable platform inserts. The inserts can be used in those areas of the platform where failures or damage has been known to occur, among other locations. If an insert becomes damaged or is destroyed during engine operation, the insert can be easily replaced, and the platform frames and the airfoil can be reused. As a result, the overall life of the vane can be extended. Further, the inserts can be made of materials that can reduce cooling requirements compared to known turbine vanes, thereby allowing cooling air to be used for other uses in the engine.

21 Claims, 3 Drawing Sheets

U.S. PATENT DOCUMENTS 6,390,769 B1 5/2002 Burdgick et al.
6,394,750 B1 * 5/2002 Hiskes ..... 415/189
6,481,971 B1 11/2002 Forrester
6,561,764 B1 5/2003 Tiemann
6,634,863 B1 10/2003 Forrester et al.
6,641,907 B1 11/2003 Merrill et al.
6,676,783 B1 1/2004 Merrill et al.
6,821,086 B1 11/2004 Brisson et al.
6,821,087 B2 11/2004 Matsumoto et al.
6,830,437 B2 12/2004 Cairo et al.
6,971,845 B2 12/2005 Weaver
2003/0082048 A1 * 5/2003 Jackson et al. ..... 415/115
2004/0001753 A1 1/2004 Tiemann
2005/0076504 A1 4/2005 Morrison et al.

FOREIGN PATENT DOCUMENTS

JP 2004084604 A * 3/2004

* cited by examiner

TURBINE VANE WITH REMOVABLE PLATFORM INSERTS

FIELD OF THE INVENTION

The invention relates in general to turbine engines and, more particularly, to turbine vanes.

BACKGROUND OF THE INVENTION

A turbine vane includes an airfoil that is bounded on each of its ends by a platform (also referred to as a shroud). Typically, the airfoil and platforms are formed together as a unitary structure. During engine operation, the vanes are cooled in order to withstand the high temperature environment of the turbine section. The high operational temperatures can impart thermal stresses on the turbine vanes, which, in turn, can result in failure of the turbine vanes. Such failures commonly manifest as cracks in the vane platforms. However, because the airfoil and the platforms are formed as a unitary structure, damage to or failure of a vane platform may require the entire vane to be scrapped. Replacement of a single vane or repair of a damaged vane platform can be time consuming, labor intensive and expensive. Thus, there is a need for a turbine vane that can minimize such concerns.

SUMMARY OF THE INVENTION

Aspects of the invention are directed to a turbine vane assembly. The assembly includes an airfoil that has a first end region and a second end region. The assembly also includes a first platform operatively connected to the first end region of the airfoil.

The first platform has a gas path face. Further, the first platform includes a first platform frame. In one embodiment, the first platform frame and the airfoil can be unitary. A receptacle, which opens to at least the gas path face, is formed in the first platform frame.

The assembly further includes an insert. The insert is removably retained in the receptacle, such as by one or more fasteners. Thus, the gas path face is defined at least in part by the first platform frame and the insert. In one embodiment, the insert can define a majority of the gas path face of the first platform.

The insert can be made of a ceramic matrix composite. Alternatively, the insert can be made of metal. In one embodiment, the insert and the first platform frame can be made of the same material. The insert can be made of a material having a lower heat resistance than the material of the first platform frame. At least a portion of the insert is coated with a thermal insulating material.

In one embodiment, the receptacle can be configured as one of a dovetail and a keyway. In such case, the insert can be contoured so as to be substantially matingly received in the receptacle. As a result, the insert can be retainably received in the receptacle. In another embodiment, the receptacle can be a recess. A plurality of passages can extend through the first platform frame and into fluid communication with the recess. Thus, a coolant can be supplied to the insert and/or the recess by way of the passages.

Another turbine vane assembly according to aspects of the invention has an airfoil with a first end region and a second end region. A first platform is operatively connected to the first end region of the airfoil. The first platform has a gas path face. The assembly also includes a second platform that is operatively connected to the second end region of the airfoil. The second platform has a gas path face.

The first platform includes a first platform frame, which can be unitary with the airfoil. One or more receptacles are provided in the first platform frame. Each receptacle opens to at least the gas path face. The assembly further includes one or more inserts. Each insert is removably retained in a respective one of the receptacles. Thus, the gas path face of the first platform is defined, at least in part, by the first platform frame and the one or more inserts. In one embodiment, the inserts can define a majority of the gas path face of the first platform. At least a portion of the one or more of the inserts can be coated with a thermal insulating material.

The second platform can include a second platform frame. The second platform frame can be unitary with the airfoil. One or more receptacles can be provided in the second platform frame. Each receptacle can open to at least the gas path face. The second platform can further include one or more inserts. Each of the one or more inserts can be removably retained in a respective one of the receptacles. The gas path face of the second platform can be defined at least in part by the second platform frame and the one or more inserts. At least a portion of one or more of the inserts can be coated with a thermal insulating material.

The first platform can have a first quantity of inserts, and the second platform can have a second quantity of inserts. The first and second quantities can be different. The inserts of the first platform can be made of a first material, and the inserts of the second platform can be made of a second material, which can be different from the first material. In one embodiment, an image of the one or more inserts of the first platform projected onto the gas path face of the second platform can at least partially overlap those portions of the gas path face defined by the one or more inserts of the second platform.

In another respect, aspects of the invention concern a method of repairing a damaged turbine vane. A turbine vane assembly is provided. The assembly includes an airfoil with a first end region and a second end region. The assembly also includes a first platform operatively connected to the first end region of the airfoil. The first platform has a gas path face. Further, the first platform includes a first platform frame. A receptacle is formed in the first platform frame that opens to at least the gas path face. An insert is removably retained in the receptacle. Thus, the gas path face is defined at least in part by the first platform frame and the insert. The insert is damaged.

The method further includes the steps of removing the damaged insert, and placing an undamaged insert into the receptacle such that it is retained in the receptacle.

DETAILED DESCRIPTION OF EMBODIMENTS OF THE INVENTION

Aspects of the present invention relate to a turbine vane assembly that includes removable platform inserts. Various embodiments of a turbine vane assembly according to aspects of the invention will be explained, but the detailed description is intended only as exemplary. Embodiments of the invention are shown in FIGS. 1-5, but the present invention is not limited to the illustrated structure or application.

Figure 1:
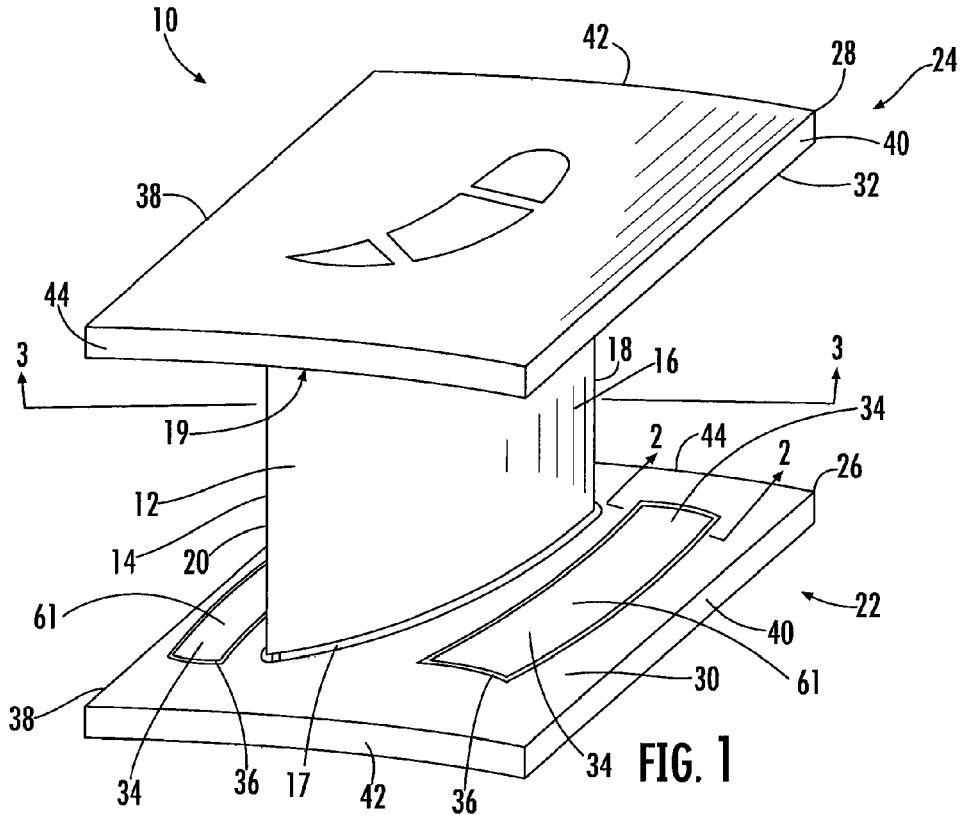
FIG. 1 is an isometric view of a turbine vane assembly with removable platform inserts according to aspects of the present invention.

FIG. 1 shows a turbine vane assembly 10 according to aspects of the invention. The turbine vane assembly 10 includes an elongated airfoil 12. The airfoil 12 has a pressure side 14 and a suction side 16. Further, the airfoil 12 has a leading edge 18 and a trailing edge 20. The airfoil 12 can have an inner end region 17 and an outer end region 19. The terms "inner" and "outer," as used herein, are intended to mean relative to the axis of the turbine when the vane assembly 10 is installed in its operational position. The turbine vane assembly 10 can also include an inner platform 22 and an outer platform 24. The inner platform 22 can include an inner platform frame 26, and the outer platform 24 can include an outer platform frame 28. The inner platform 22 can have a gas path face 30, which is directly exposed to the turbine gas flow path. Similarly, the outer platform 24 can have a gas path face 32, which is also directly exposed to the turbine gas flow path.

Figure 5:
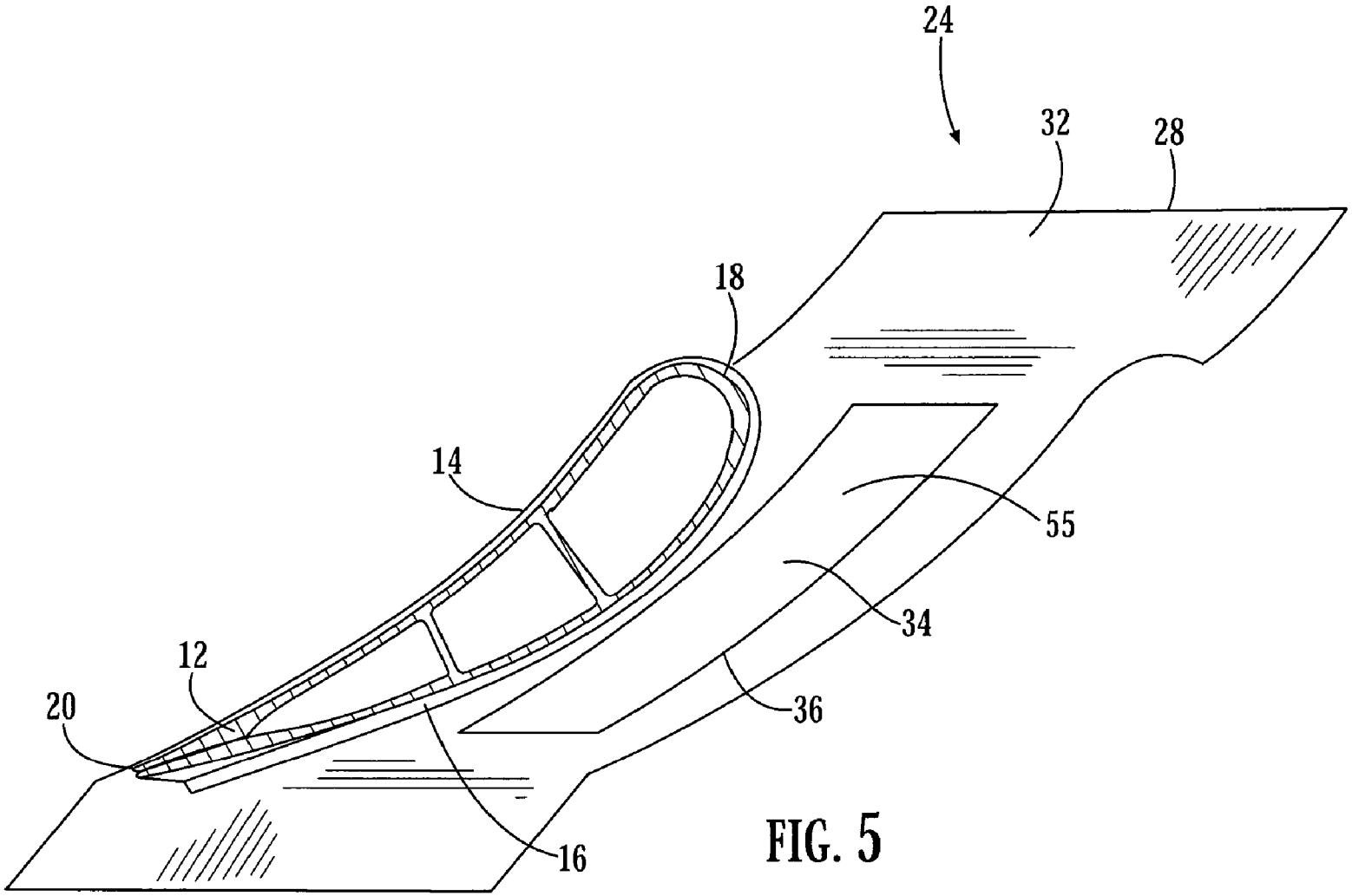
FIG. 5 is a cross-sectional view of a turbine vane assembly according to aspects of the invention, showing an alternative platform configuration.

Each end region 17,19 of the airfoil 12 can transition into a respective one of the platforms 22, 24. The airfoil 12 can be substantially centered on each of the platforms 22, 24, such as shown in FIG. 1. Alternatively, the airfoil 12 can be offset from the center of each platform 22, 24 in any of a number of ways. For example, FIG. 5 shows an embodiment in which the outer platform 24 is formed almost entirely on the suction side 16 of the airfoil 12. Naturally, the inner platform 22 can be similarly configured. However, it will be understood that aspects of the invention are not limited to any particular arrangement or relationship between the airfoil 12 and the platforms 22, 24.

The airfoil 12 and the platform frames 26, 28 can be formed in any of a number of ways. In one embodiment, the airfoil 12 and the platform frames 26, 28 can be a unitary structure formed by, for example, casting or forging. That is, the airfoil 12 and at least a portion of each platform frame 26, 28 can be formed as a single piece. Alternatively, at least one of the inner platform frame 26, the outer platform frame 28 and the airfoil 12 can be formed separately and subsequently joined in any suitable manner. For example, the airfoil 12 can be unitary with one of the platform frames 26 or 28, and the other platform frame can be separately formed. The outer platform frame 28 can be operatively connected to the airfoil 12 at the outer end region 19; the inner platform frame 26 can be operatively connected to the airfoil 12 at the inner end region 17.

According to aspects of the invention, at least one of the platform frames 26, 28 can include a receptacle to receive an insert 34. Aspects of the invention will be explained in the context of both the inner and outer platform frames 26, 28 being so adapted, but it will be understood that aspects of the invention are not limited to such an embodiment. In one embodiment, the receptacle can be a recess 36. The inner platform frame 26 can include a recess 36 that opens to the hot gas path face 30 of the inner platform 22. From the gas path face 30, the recess 36 can extend at a depth into the thickness of the inner platform frame 26. Similarly, the outer platform frame 28 can include a recess 36 that can open to the hot gas path face 32 of the outer platform 24 and can extend therefrom at a depth into the thickness of the outer platform frame 28. In some instances, the receptacle can be a passage 39 that extends through the thickness of the platforms 26, 28 (see FIG. 2B). The receptacle can be formed with the platform frames 26, 28, such as during casting or forging, or it can be formed in a subsequent operation, such as by machining or other suitable technique. The following discussion will be directed to an embodiment in which the receptacle is a recess 36, but it will be understood that aspects of the invention are not limited to this specific embodiment.

The inner and outer platforms 22, 24 can be completed by placing an insert 34 into each recess 36 of the respective platform frame 26, 28. The inserts 34 and the recesses 36 can be configured so that the inserts 34 are substantially matingly received within the recess 36. When installed, a portion of each insert 34 can form a portion of the gas path face 30 or 32 of the respective platform 22 or 24. Ideally, the inserts 34 are substantially flush with those portions of the inner and platform frames 26, 28 that form the gas path faces 30, 32.

The inserts 34 can be made of any of a number of materials. For example, the inserts 34 can be made of ceramic matrix composite (CMC) 55 (see FIG. 5), such as a silicone-carbide CMC. In one embodiment, the inserts 34 can be made of an oxide-based hybrid CMC system, such as disclosed in U.S. Pat. Nos. 6,676,783; 6,641,907; 6,287,511; and 6,013,592, which are incorporated herein by reference. The inserts 34 can be made of metal, such as a single crystal advanced alloy. In one embodiment, the inserts 34 can be made of the same material as the respective platform frame 26, 28 in which they are received, such as IN939 alloy and ECY768 alloy. The inserts 34 can be made of a material that may or may not have a greater resistance to heat compared to the material of the platform frames 26, 28. For example, the inserts 34 can be made of a material 57 with a lower heat resistance than the material 59 of the receiving platform frames 26, 28 (see FIG. 2A). The inserts 34 can be made from an inexpensive material so that the cost of a replacement insert would not significantly add to the overall costs over the life of the engine.

It should be noted that the material of the inserts 34 of the outer platform 24 can be identical to the material of the inserts 34 of the inner platform 22, but they can also be different. In one embodiment, the inserts 34 of the inner platform 22 can be made of a first material 61 (see FIG. 1), and the inserts 34 of the outer platform 24 can be made of a second, different material 63 (see FIG. 3). Likewise, in embodiments where one or both platforms 22, 24 have a plurality of inserts 34, the inserts 34 associated with one of the platforms can all be made of the same material or at least one of the inserts 34 be made of a different material.

In some instances, it may be desirable to coat, cover or otherwise treat at least a portion of the inserts 34 so as to provide one or more types of protection from the turbine environment, among other things. For example, in the case of inserts 34 made of CMC, at least those portions of the inserts 34 that form the gas path faces 30, 32 of the vane assembly 10 can be coated with a thermal insulating material, which can be, for example, a friable graded insulation (FGI) 37 (see FIG. 2A). Examples of FGI are disclosed in U.S. Pat. Nos. 6,676,783; 6,641,907; 6,287,511; and 6,013,592, which are incorporated herein by reference.

Figure 2A:
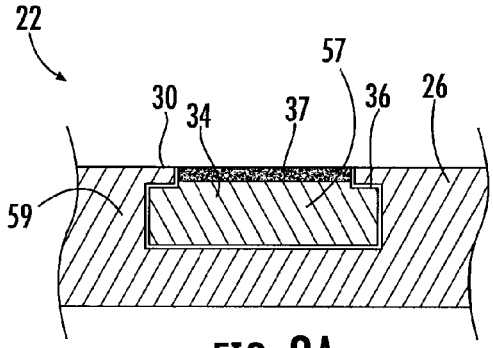
FIG. 2A is a cross-sectional view of a turbine vane assembly according to aspects of the invention, viewed from line 2-2 in FIG. 1.
Figure 2B:
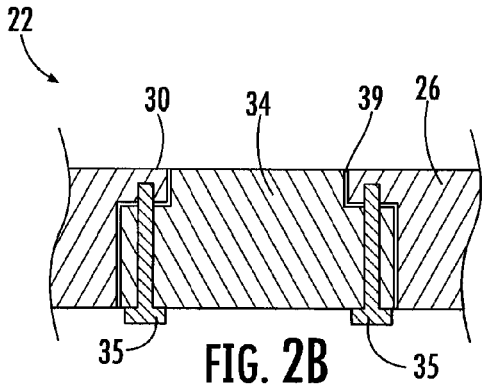
FIG. 2B is a cross-sectional view of a turbine vane assembly according to aspects of the invention, viewed from line 2-2 in FIG. 1, showing the insert extending through the platform frame.

To prevent the insert liberating during engine operation and entering the gas flow path, which can result in significant damage, each insert 34 can be retainably received in a respective one of the recesses 36. The inserts 34 can be retained in the recesses 36 in any of a number of ways. For example, the recesses 36 can be configured as a keyway or a dovetail, as shown in FIGS. 2A and 2B. In one embodiment, the recesses 36 can extend through to one of the axial or circumferential sides 38, 40, 42, 44 of the platform frames 26, 28. In such case, an insert 34 can be slid into a respective recess 36 from the side of the platform frame 26, 28. The insert 34 can be retained in place not only by the keyway or dovetail recess 36, but also by engagement with an abutting structure, such as a portion of an adjacent turbine vane (not shown) or a vane carrier (not shown). Alternatively or in addition, the inserts 34 can be retained in the recesses 36 by one or more fasteners, such as bolts 35, as shown in FIG. 2B. The inserts 34 can be retained by any suitable system so long as it facilitates the subsequent removal of the inserts 34.

Figure 3:
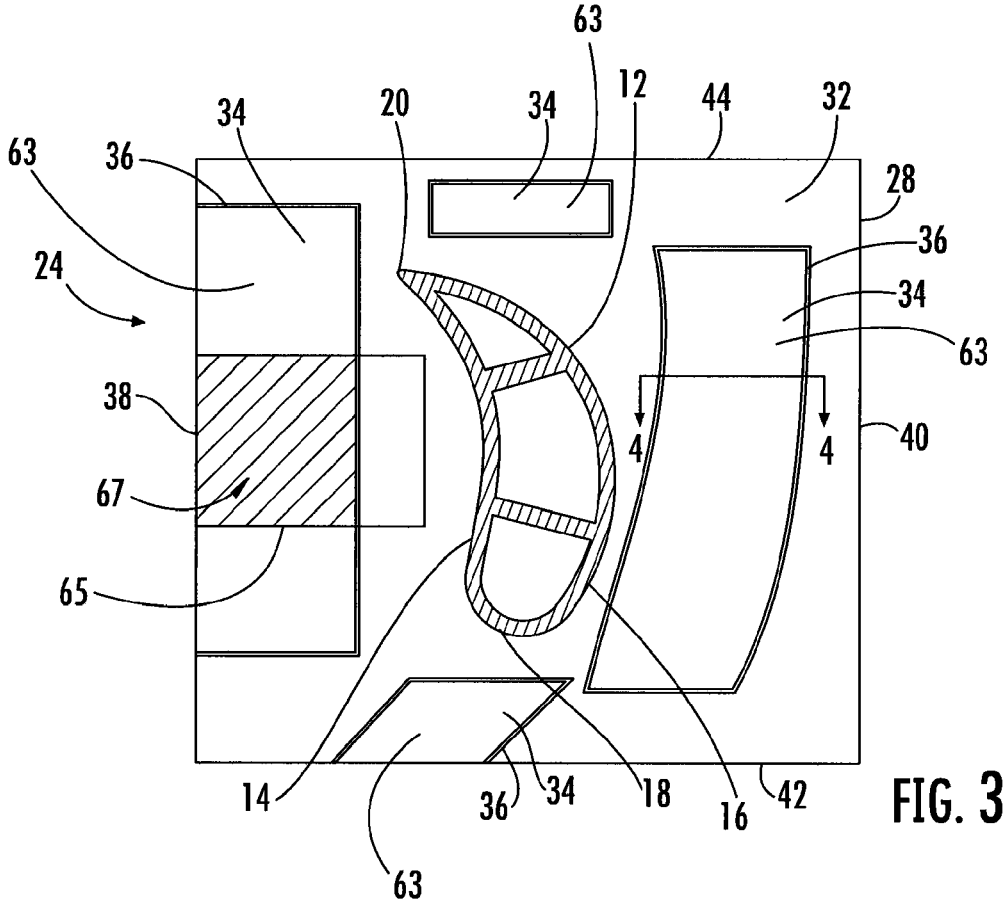
FIG. 3 is a cross-sectional view of a turbine vane assembly according to aspects of the invention, viewed from line 3-3 in FIG. 1.

The inserts 34 can have any suitable shape. For example, the inserts 34 can be generally rectangular, triangular, polygonal, oval, circular, and irregular, just to name a few possibilities. However, aspects of the invention are not limited to any particular shape. The inserts 34 can be sized and shaped as needed to provide the desired area of coverage. Likewise, the location of the inserts 34 on the platforms 22, 24 can be optimized as needed. For instance, the inserts 34 can be positioned in critical areas, such as areas that are known hot spots during engine operation. The inserts 34 can even be used to form a majority of one or both of the platform gas path faces 30, 32 of the vane assembly 10. There can be any number of inserts 34 associated with each platform 22, 24, though the quantity of inserts 34 associated with the inner platform 22 may or may not be the same as the quantity of inserts 34 associated with the outer platform 24. In the embodiment, there can be two inserts 34 associated with at least one of the platforms 22, 24. For example, one insert 34 can be located between the pressure side 14 of the airfoil 12 and a first circumferential side 38 of the platforms 22, 24. The other insert 34 can be located between the suction side 16 of the airfoil 12 and a second circumferential side 40 of the platforms 22, 24. Of course, the inserts 34 can be located in various other places as well. For instance, as shown in FIG. 3, one or more inserts 34 can also be provided between the leading edge 18 of the airfoil 12 and a first axial side 42 of the platforms 22, 24. Likewise, one or more inserts 34 can be provided between the trailing edge 20 of the airfoil 12 and a second axial side 44 of each platform 22, 24.

The size, location, quantity, arrangement, areas of coverage, etc. of the inserts 34 on the inner platform 22 may or may not be substantially identical in one or more these respects with the inserts 34 on the outer platform 24. For instance, there can be two inserts 34 on the outer platform 24, while the inner platform 22 can have one. Further, an image 65 of an insert 34 on one of the platforms 22, 24 can be projected onto the gas path face 30, 32 of the opposite platform. In one embodiment, the projected image 65 can at least partially overlap 67 at least one of the inserts 34 on the opposite platform (see FIG. 3). Alternatively, the projected image 65 may not overlap any of the inserts 34 on the opposite platform.

In a given row of turbine vanes, at least one of the vanes in the row can be a vane assembly 10 in accordance with aspects of the invention. Similarly, the quantity and arrangement of the vane assemblies 10 in a given row of vanes may or may not be identical to another row in the turbine section.

During engine operation, a coolant, such as air, can be supplied to the platforms to cool the platform frames 26, 28 as well as the inserts 34. The inserts 34 can act as heat shields. However, if an insert 34 degrades or becomes damaged, then an outage can be scheduled for replacement of the inserts 34. The platform frames 26, 28 and the airfoil 12 can be reused, thereby minimizing scrap and potentially extending the overall vane life.

Figure 4:
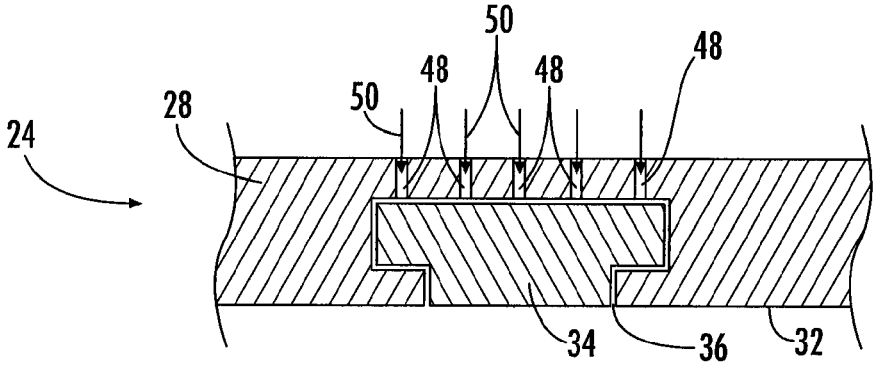
FIG. 4 is a cross-sectional view of a turbine vane assembly according to aspects of the invention, viewed from line 4-4 in FIG. 3, showing a fail safe configuration in the event of major or total insert failure.

The turbine vane assembly 10 according to aspects of the invention can include fail safe features in the event of substantial or total failure of one or more inserts 34. To that end, one or more passages 48 can extend through the platforms 22, 24 and open to the recesses 36, as shown in FIG. 4. Even if the insert 34 was completely destroyed, a coolant 50 can flow through the passages 48 to provide local cooling. Upon exiting the passages 48, the coolant 50 can then enter the turbine gas path. Thus, the engine could still safely continue to operate, though there would be an increase in cooling air consumption until the insert 34 is replaced. Further, under normal operating conditions when the insert 34 is intact, the passages 48 can be used to impingement cool the inserts 34 and portions of the platforms 22, 24.

The turbine vane assembly 10 according to aspects of the invention can provide numerous advantages over known turbine vanes. As described above, the turbine vane assembly 10 can provide for improved maintainability (less and easier maintenance), reduced repair costs, and reduced scrap. Further, the vane assembly 10 according to aspects of the invention can reduce cooling air consumption compared to known turbine vanes. For instance, the gas path faces of the platforms of known turbine vanes are film cooled, and the backside of the platforms are cooled as well. With inserts made of certain material systems in accordance with aspects of the invention, it may be possible to eliminate platform film cooling and/or significantly reduce the amount of backside cooling. Such cooling savings allow the cooling air to be used for other purposes in the engine.

The foregoing description is provided in the context of various embodiments of a turbine vane assembly in accordance with aspects of the invention. Thus, it will of course be understood that the invention is not limited to the specific details described herein, which are given by way of example only, and that various modifications and alterations are possible within the scope of the invention as defined in the following claims.

What is claimed is:

1. A turbine vane assembly comprising:

an airfoil having a first end region and a second end region;

a first platform operatively connected to the first end region of the airfoil, the first platform having a gas path face, the first platform including a first platform frame having a receptacle therein, the receptacle opening to at least the gas path face; and an insert removably retained in the receptacle, wherein the gas path face is defined at least in part by the first platform frame and the insert, wherein a plurality of passages extend through the first platform frame and into fluid communication with the receptacle, whereby a coolant can be supplied to the insert and/or the receptacle.

2. The turbine vane assembly of claim 1 wherein the insert is made of a ceramic matrix composite.

3. The turbine vane assembly of claim 1 wherein the insert is retained in the receptacle by at least one fastener.

4. The turbine vane assembly of claim 1 wherein the insert is made of metal.

5. The turbine vane assembly of claim 1 wherein the insert and the first platform frame are made of the same material.

6. The turbine vane assembly of claim 1 wherein the insert is made of a material having a lower heat resistance than the material of the first platform frame.

7. The turbine vane assembly of claim 1 wherein at least a portion of the insert is coated with a thermal insulating material.

8. The turbine vane assembly of claim 1 wherein the insert defines a majority of the gas path face of the first platform.

9. The turbine vane assembly of claim 1 wherein the first platform frame and the airfoil are unitary.

10. The turbine vane assembly of claim 1 wherein the receptacle is configured as one of a dovetail and a keyway, and wherein the insert is contoured so as to be substantially matingly received in the receptacle, whereby the insert is retainably received in the receptacle.

11. The turbine vane assembly of claim 1 wherein the receptacle is a recess.

12. A turbine vane assembly comprising:

an airfoil having a first end region and a second end region;

a first platform operatively connected to the first end region of the airfoil, the first platform having a gas path face, the first platform including a first platform frame having at least one receptacle therein, each of the receptacles opening to at least the gas path face, and at least one insert, each of the at least one inserts being removably retained in one of the receptacles, wherein the insert is associated entirely with the first platform and forms no portion of the airfoil, wherein the insert is made of a material having a lower heat resistance than the material of the first platform frame, wherein the gas path face is defined at least in part by the first platform frame and the at least one insert.

13. The turbine vane assembly of claim 12 further including a second platform operatively connected to the second end region of the airfoil, the second platform having a gas path face, wherein the second platform includes a second platform frame having at least one receptacle therein, each of the receptacles opening to at least the gas path face, and further including at least one insert, each of the at least one inserts being removably retained in each of the receptacles, wherein the gas path face of the second platform is defined at least in part by the second platform frame and the at least one insert.

14. The turbine vane assembly of claim 13 wherein the first platform has a first quantity of inserts and the second platform has a second quantity of inserts, wherein the first and second quantities are different.

15. The turbine vane assembly of claim 13 wherein the inserts of the first platform are made of a first material, and the inserts of the second platform are made of a second material, wherein the first and second materials are different.

16. The turbine vane assembly of claim 13 wherein at least a portion of at least one of the inserts is coated with a thermal insulating material.

17. The turbine vane assembly of claim 13 wherein the at least one insert defines a majority of the gas path face of the first platform.

18. The turbine vane assembly of claim 13 wherein the first and second platform frames are unitary with the airfoil.

19. The turbine vane assembly of claim 13 wherein an image of the at least one insert of the first platform projected onto the gas path face of the second platform at least partially overlaps those portions of the gas path face defined by the at least one insert of the second platform.

20. A method of repairing a damaged turbine vane comprising the steps of:

(a) providing a turbine vane assembly that includes:

an airfoil having a first end region and a second end region;

a first platform operatively connected to the first end region of the airfoil, the first platform having a gas path face, the first platform including a first platform frame having a receptacle therein, the receptacle opening to at least the gas path face; and an insert removably retained in the receptacle, wherein the gas path face is defined at least in part by the first platform frame and the insert, wherein the insert is associated entirely with the first platform and forms no portion of the airfoil, wherein the insert is damaged;

(b) removing the damaged insert; and (c) placing an undamaged insert into the receptacle so that the undamaged insert is retained therein.

21. A turbine vane assembly comprising:

an airfoil having a first end region and a second end region;

a first platform operatively connected to the first end region of the airfoil, the first platform having a gas path face and an associated thickness, the first platform having a first circumferential side and a second circumferential side, the first platform including a first platform frame having a recess therein, the recess opening to the gas path face and one of the circumferential sides, wherein the recess does not extend through the entire thickness of the first platform; and an insert being received and removably retained in the receptacle, wherein the gas path face is partially defined by the insert and wherein one of the circumferential sides is partially defined by the insert, wherein the insert is associated entirely with the first platform and forms no portion of the airfoil, whereby the insert is inserted and removed from the recess through the recess opening in the circumferential side of the first platform.

* * * * *